US008481833B1

(12) United States Patent
Wachowiak et al.

(10) Patent No.: US 8,481,833 B1
(45) Date of Patent: Jul. 9, 2013

(54) FREE FLOATING DRUM HEAD TENSIONING SYSTEM

(76) Inventors: Gary L. Wachowiak, St. Petersburg, FL (US); Jennifer P. Wachowiak, St. Petersburg, FL (US)

( * ) Notice: Subject to any disclaimer, the term of this patent is extended or adjusted under 35 U.S.C. 154(b) by 0 days.

(21) Appl. No.: 12/932,006

(22) Filed: Feb. 16, 2011

(51) Int. Cl.
*G10D 13/02* (2006.01)

(52) U.S. Cl.
USPC ..... 84/411 R

(58) Field of Classification Search
USPC ..... 84/411 R, 413–415, 421
See application file for complete search history.

(56) References Cited

U.S. PATENT DOCUMENTS 7,501,567 B1 * 3/2009 Spinazzola ..... 84/411 R
2008/0127804 A1 * 6/2008 Lashbrook et al. ..... 84/411 R

* cited by examiner

*Primary Examiner* — Kimberly Lockett

(57) ABSTRACT

A drum shell has upper and lower peripheral edges. A flexible drum head is provided over at least one peripheral edge. Upper and lower hoops have vertical sections adjacent to the upper and lower edges. Each vertical section has horizontal regions. The horizontal regions have first and second apertures. A plurality of lug bodies are provided. Each lug body has a first end extending through a first aperture. Each lug body has a second end located adjacent to a second aperture. A plurality of threaded tension rods is provided. Each threaded tension rod has a head and a threaded end. Each tension rod extends through a second aperture. Each tension rod is threadedly coupled to the second end of a lug body.

3 Claims, 3 Drawing Sheets

FIG. 2
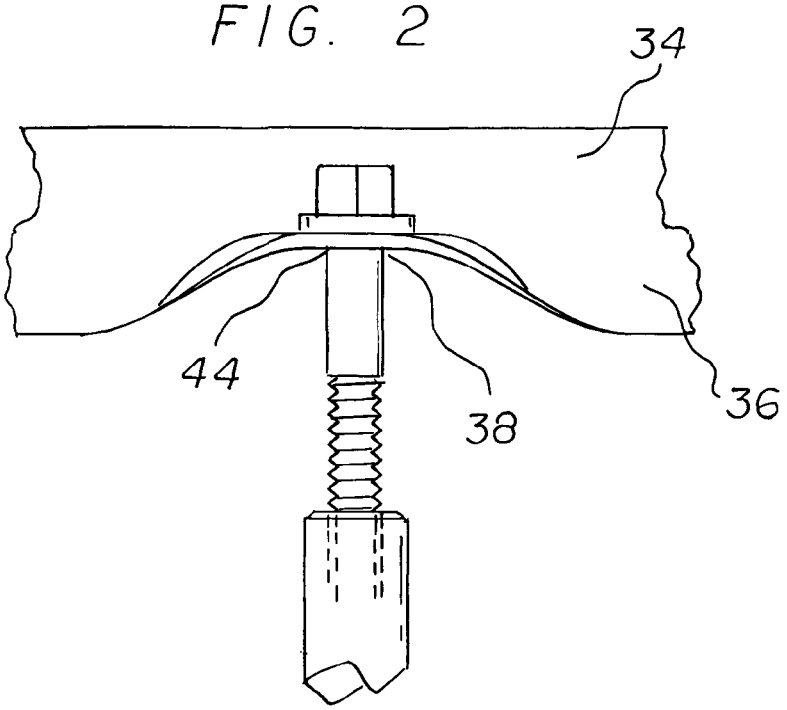
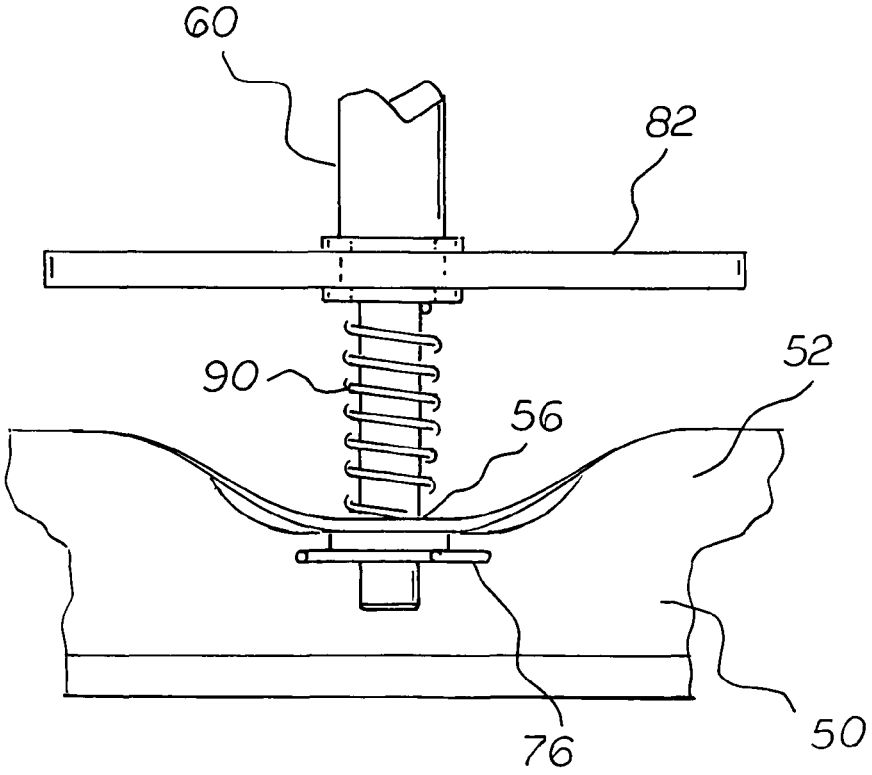
FIG. 3

FREE FLOATING DRUM HEAD TENSIONING SYSTEM

BACKGROUND OF THE INVENTION

1. Field of the Invention

The present invention relates to a free floating drum head tensioning system and more particularly pertains to equally and oppositely tensioning upper and lower drum heads on a shell, the tensioning being achieved in a more convenient, more reliable and more economical manner.

2. Description of the Prior Art

The use of drum tensioners of known designs and configurations is known in the prior art. More specifically, drum tensioners previously devised and utilized for the purpose of tensioning drum heads are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,334,459 issued Jun. 15, 1982 Grauso relates to a Suspension Band Drum. U.S. Pat. No. 5,413,022 issued May 19, 1995 to Sleishman relates to a Drum with Free Floating Tensioning Assembly. U.S. Pat. No. 6,417,432 issued Jul. 9, 2002 to Downing relates to a Mymi Free Floating Drum. Lastly, U.S. Pat. No. 6,963,022 issued Nov. 8, 2005 to Okuno relates to a Drum and Head Diaphragm Adjustor for Drums.

While these devices fulfill their respective, particular objectives and requirements, the aforementioned patents do not describe a free floating drum head tensioning system that allows for equally and oppositely tensioning upper and lower drum heads on a shell, the tensioning being achieved in a more convenient, more reliable and more economical manner.

In this respect, the free floating drum head tensioning system accorded to the present invention substantially departs from the conventional concepts and designs of the prior art, and in doing so provides an apparatus primarily developed for the purpose of equally and oppositely tensioning upper and lower drum heads on a shell, the tensioning being achieved in a more convenient, more reliable and more economical manner.

Therefore, it can be appreciated that there exists a continuing need for a new and improved free floating drum head tensioning system which can be used for equally and oppositely tensioning upper and lower drum heads on a shell, the tensioning being achieved in a more convenient, more reliable and more economical manner. In this regard, the present invention substantially fulfills this need.

SUMMARY OF THE INVENTION

In view of the foregoing disadvantages inherent in the known types of tensioning systems of known designs and configurations now present in the prior art, the present invention provides an improved free floating drum head tensioning system. As such, the general purpose of the present invention, which will be described subsequently in greater detail, is to provide a new and improved free floating drum head tensioning system and method which has all the advantages of the prior art and fewer of the disadvantages.

To attain this, the present invention essentially comprises a free floating drum head tensioning system. First provided is a rigid drum shell. The drum shell is in a hollow cylindrical configuration. The drum shell has an interior surface. The drum shell has an exterior surface. The drum shell has an upper peripheral edge. The drum shell has a lower peripheral edge. The upper and lower peripheral edges are provided in spaced parallel planes.

A flexible upper drum head is provided. The upper drum head extends across the upper peripheral edge. The upper drum head further extends downwardly along the exterior surface. A flexible lower drum head is provided. The lower drum head extends across the lower peripheral edge. The lower drum head further extends upwardly along the exterior surface.

An upper hoop is provided. The upper hoop has a circular vertical upper section. In this manner the upper drum head is continuously secured against the shell adjacent to the upper peripheral edge. The upper hoop has a circular vertical lower section. In this manner the upper drum head is non-continuously secured against the shell adjacent to the vertical upper section of the upper hoop. The vertical lower section of the upper hoop has horizontal regions. The horizontal regions are symmetrically spaced around the drum shell. Each horizontal region of the upper hoop has an upper aperture.

A lower hoop is provided. The lower hoop has a circular vertical lower section. In this manner the lower drum head is continuously secured against the shell adjacent to the lower peripheral edge. The lower hoop has a circular vertical upper section. In this manner the lower drum head is non-continuously against the shell adjacent to the vertical lower section of the lower hoop. The vertical lower section of the lower hoop has horizontal regions. The horizontally regions are symmetrically spaced around the drum shell. Each horizontal region of the lower hoop has a lower aperture. Each lower aperture has an associated upper aperture. The hoops are fabricated of a generally rigid material. The generally rigid material is chosen from the class of generally rigid materials. The class of generally rigid materials includes metal, plastic, composites and wood.

A plurality of lug bodies is provided next. Each lug body has a lower end. The lower end of the lug body extends through a lower aperture. Each lug body has a drilled and threaded upper end. The upper end is located beneath an associated upper aperture.

Provided next is a plurality of threaded tension rods. Each threaded tension rod has a head above. Each threaded tension rod has a threaded end below. Each tension rod extends downwardly through an upper aperture. Each tension rod is threadedly coupled to the drilled and threaded upper end of a lug body. A flat washer is provided. The flat washer encompasses each threaded tension rod between a head and an upper aperture. The threaded tension rods are adapted to tighten and loosen the tension of the drum heads.

Further provided is a diametric aperture. A diametric aperture is provided in each lug body adjacent to the lower end. Each diametric aperture is positioned below a lower aperture. A cotter pin is provided. The cotter pin extends through each diametric aperture. A washer is provided. The washer is positioned between each lower aperture and a lower aperture.

Provided last is plurality of shaft stops. Each shaft stop has a V-shaped exterior configuration. Each shaft stop has a D-shaped aperture. Each lug body has a D-shaped surface. The D-shaped surface is spaced above the lower aperture receiving the D-shaped aperture. Each lug body has spaced grooves. The grooves are above and below a shaft stop. Each groove has a snap ring. In this manner the shaft stop is axially fixed on a lug body. The stop shafts are adapted to prevent rotation of lug body while pressure is being applied to the drum heads. A coil spring is provided. The coil spring encircles each lug body between a lower aperture and a shaft stop. The coil spring is adapted to prevent the lug body from dropping down due to vibrations loosening the tension rods.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved free floating drum head tensioning system which has all of the advantages of the prior art tensioning systems of known designs and configurations and none of the disadvantages.

It is another object of the present invention to provide a new and improved free floating drum head tensioning system which may be easily and efficiently manufactured and marketed.

It is further object of the present invention to provide a new and improved free floating drum head tensioning system which is of durable and more reliable constructions.

An even further object of the present invention is to provide a new and improved free floating drum head tensioning system which is susceptible of a low cost of manufacture with regard to both materials and labor, and which accordingly is then susceptible of low prices of sale to the consuming public, thereby making such free floating drum head tensioning system economically available to the buying public.

Even still another object of the present invention is to provide a free floating drum head tensioning system for equally and oppositely tensioning upper and lower drum heads on a shell, the tensioning being achieved in a more convenient, more reliable and more economical manner.

Lastly, it is an object of the present invention to provide a new and improved free floating drum head tensioning system. A drum shell has upper and lower peripheral edges. A flexible drum head is provided over at least one peripheral edge. Upper and lower hoops have vertical sections adjacent to the upper and lower edges. Each vertical section has horizontal regions. The horizontal regions have first and second apertures. A plurality of lug bodies are provided. Each lug body has a first end extending through a first aperture. Each lug body has a second end located adjacent to a second aperture. A plurality of threaded tension rods is provided. Each threaded tension rod has a head and a threaded end. Each tension rod extends through a second aperture. Each tension rod is threadedly coupled to the second end of a lug body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a front elevational view of the upper portion of the system taken along line 2-2 of FIG. 1.

FIG. 3 is a front elevational view of the lower portion of the system taken along line 2-2 of FIG. 1.

The same reference numerals refer to the same parts throughout the various Figures.

DESCRIPTION OF THE PREFERRED EMBODIMENT

Figure 1:
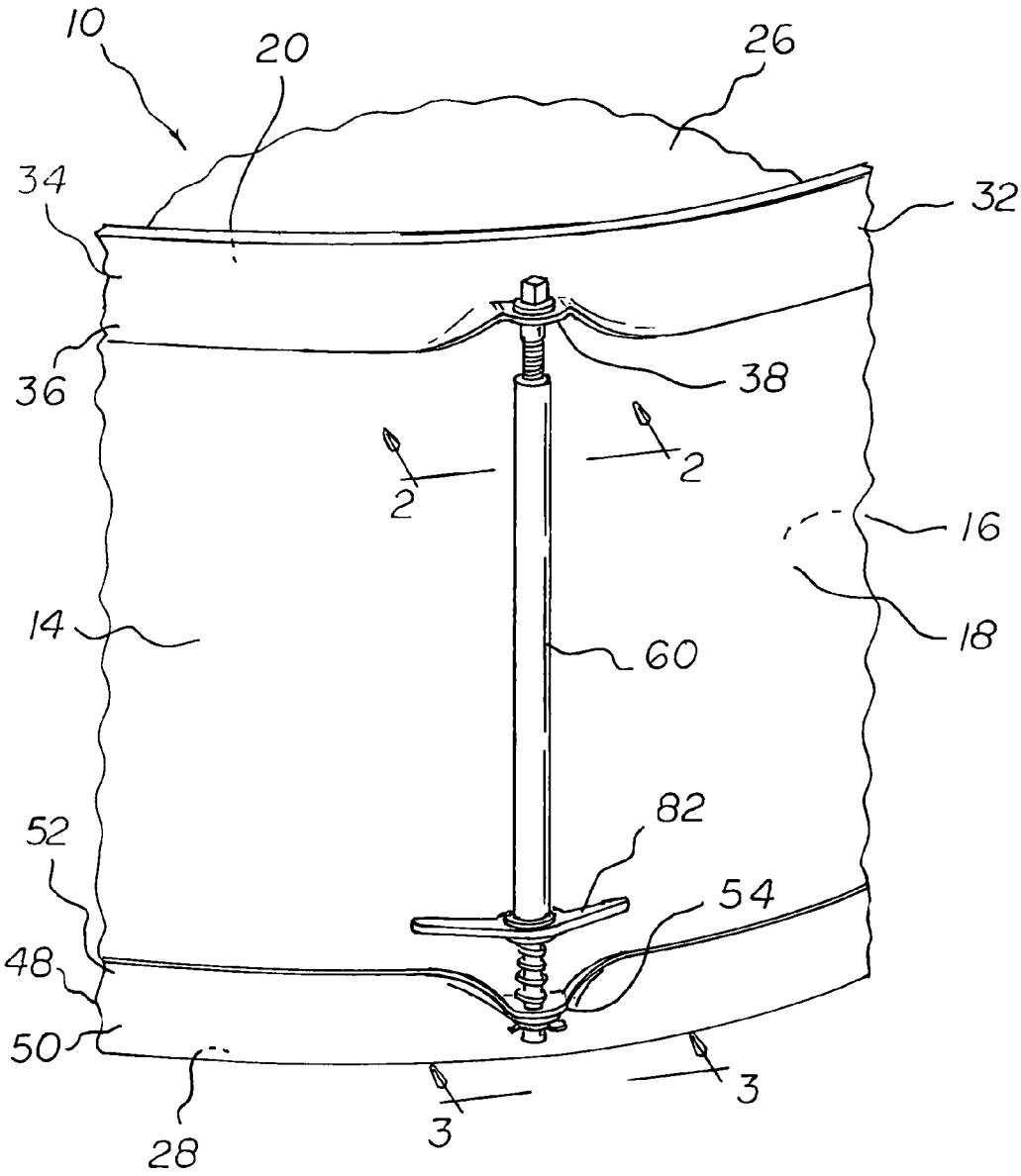
FIG. 1 is a perspective illustration of a free floating drum head tensioning system constructed in accordance with the principles of the present invention.
Figure 4:
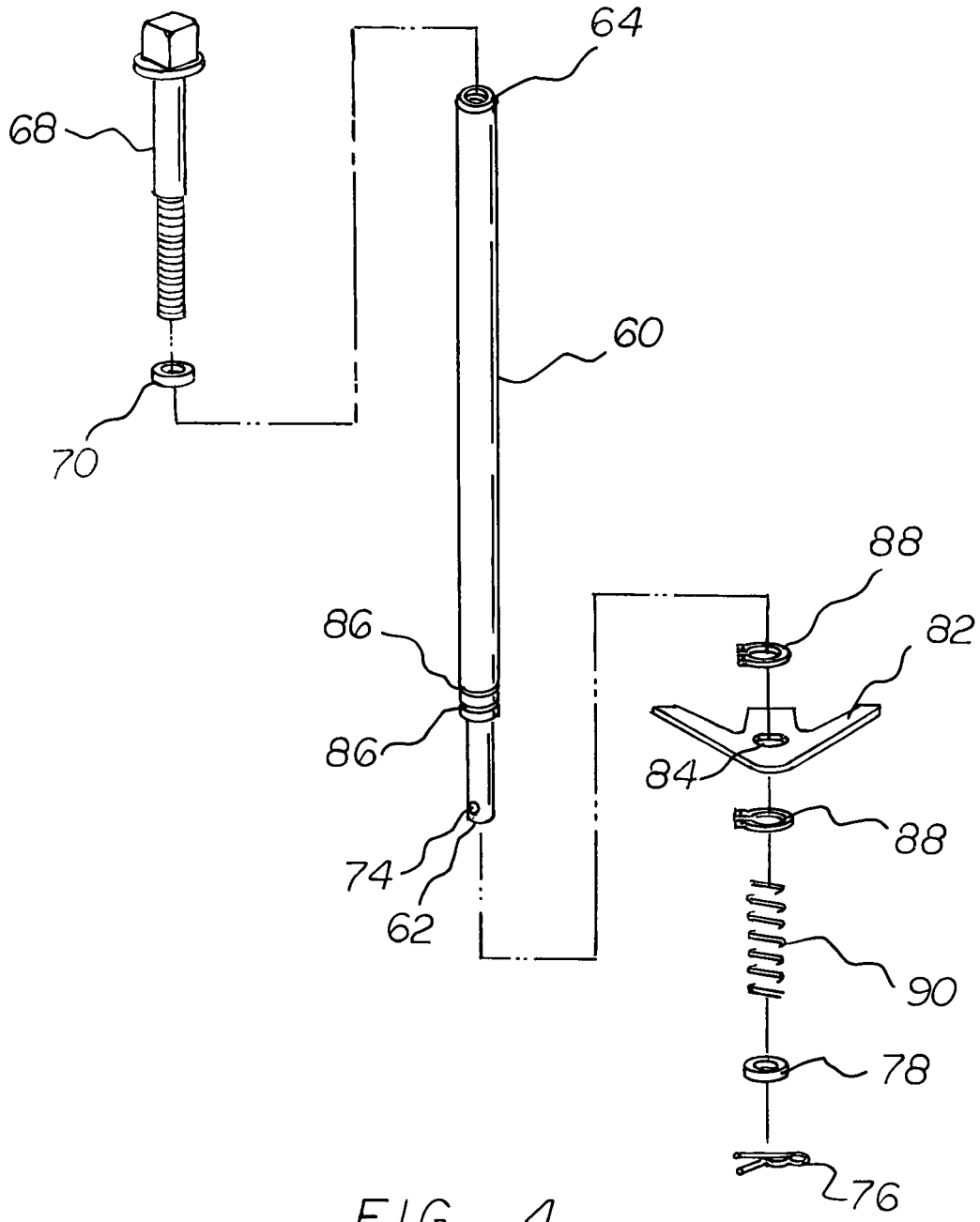
FIG. 4 is an exploded perspective showing of the tensioning assembly of the prior Figures.

With reference now to the drawings, and in particular to FIG. 1 thereof, the preferred embodiment of the new and improved free floating drum head tensioning system embodying the principles and concepts of the present invention and generally designated by the reference numeral 10 will be described.

The present invention, the free floating drum head tensioning system 10 is comprised of a plurality of components. Such components in their broadest context include a drum shell, upper and lower hoops, a plurality of lug bodies, and a plurality of tension rods. Such components are individually configured and correlated with respect to each other so as to attain the desired objective.

First provided is a rigid drum shell 14. The drum shell is in a hollow cylindrical configuration. The drum shell has an interior surface 16. The drum shell has an exterior surface 18. The drum shell has an upper peripheral edge 20. The drum shell has a lower peripheral edge 22. The upper and lower peripheral edges are provided in spaced parallel planes.

A flexible upper drum head 26 is provided. The upper drum head extends across the upper peripheral edge. The upper drum head further extends downwardly along the exterior surface. A flexible lower drum head 28 is provided. The lower drum head extends across the lower peripheral edge. The lower drum head further extends upwardly along the exterior surface.

An upper hoop 32 is provided. The upper hoop has a circular vertical upper section 34. In this manner the upper drum head is continuously secured against the shell adjacent to the upper peripheral edge. The upper hoop has a circular vertical lower section 36. In this manner the upper drum head is non-continuously secured against the shell adjacent to the vertical upper section of the upper hoop. The vertical lower section of the upper hoop has horizontal regions 38. The horizontal regions are symmetrically spaced around the drum shell. Each horizontal region of the upper hoop has an upper aperture 44.

A lower hoop 48 is provided. The lower hoop has a circular vertical lower section 50. In this manner the lower drum head is continuously secured against the shell adjacent to the lower peripheral edge. The lower hoop has a circular vertical upper section 52. In this manner the lower drum head is non-continuously against the shell adjacent to the vertical lower section of the lower hoop. The vertical lower section of the lower hoop has horizontal regions 54. The horizontally regions are symmetrically spaced around the drum shell. Each horizontal region of the lower hoop has a lower aperture 56. Each lower aperture has an associated upper aperture. The hoops are fabricated of a generally rigid material. The generally rigid material is chosen from the class of generally rigid materials. The class of generally rigid materials includes metal, plastic, composites and wood.

A plurality of lug bodies 60 is provided next. Each lug body has a lower end 62. The lower end of the lug body extends through a lower aperture. Each lug body has a drilled and threaded upper end 64. The upper end is located beneath an associated upper aperture.

Provided next is a plurality of threaded tension rods 68. Each threaded tension rod has a head above. Each threaded tension rod has a threaded end below. Each tension rod, extends downwardly through an upper aperture. Each tension rod is threadedly coupled to the drilled and threaded upper end of a lug body. A flat washer 70 is provided. The flat washer encompasses each threaded tension rod between a head and an upper aperture. The threaded tension rods are adapted to tighten and loosen the tension of the drum heads.

Further provided is a diametric aperture 74. A diametric aperture is provided in each lug body adjacent to the lower end. Each diametric aperture is positioned below a lower aperture. A cotter pin 76 is provided. The cotter pin extends through each diametric aperture. A washer 78 is provided. The washer is positioned between each lower aperture and a lower aperture.

Provided last is plurality of shaft stops 82. Each shaft stop has a V-shaped exterior configuration. Each shaft stop has a D-shaped aperture 84. Each lug body has a D-shaped surface. The D-shaped surface is spaced above the lower aperture receiving the D-shaped aperture. Each lug body has spaced grooves 86. The grooves are above and below a shaft stop. Each groove has a snap ring 88. In this manner the shaft stop is axially fixed on a lug body. The stop shafts are adapted to prevent rotation of lug body while pressure is being applied to the drum heads. A coil spring 90 is provided. The coil spring encircles each lug body between a lower aperture and a shaft stop. The coil spring is adapted to prevent the lug body from dropping down due to vibrations loosening the tension rods.

One upper aperture, one lower aperture, one lug body, one threaded tension rod with associated elements constitute a coupling assembly. Only one such coupling assembly is illustrated. It should be understood, however, that a plurality of such coupling assemblies are intended to be utilized in each drum system with such plurality of coupling assemblies located symmetrically around the drum shell in the conventional manner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A free floating drum head tensioning system comprising:

a drum shell having upper and lower peripheral edges, a flexible drum head over at least one peripheral edge;

upper and lower hoops having vertical sections adjacent to the upper and lower edges, each vertical section having horizontal regions, the horizontal regions having first and second apertures;

a plurality of lug bodies, each lug body having a first end extending through a first aperture, each lug body having a second end located adjacent to a second aperture;

a plurality of threaded tension rods, each threaded tension rod having a head and a threaded end extending through a second aperture and threadedly coupled to the second end of a lug body; and a plurality of shaft stops, each having a V-shaped exterior configuration with a D-shaped aperture, each lug body having a D-shaped surface spaced from the second aperture receiving the D-shaped aperture, the stop shafts adapted to prevent rotation of lug body while pressure is being applied to the drum head.

2. A free floating drum head tensioning system comprising:

a drum shell having upper and lower peripheral edges, a flexible drum head over at least one peripheral edge;

upper and lower hoops having vertical sections adjacent to the upper and lower edges, each vertical section having horizontal regions, the horizontal regions having first and second apertures;

a plurality of lug bodies, each lug body having a first end extending through a first aperture, each lug body having a second end located adjacent to a second aperture;

a plurality of threaded tension rods, each threaded tension rod having a head and a threaded end extending through a second aperture and threadedly coupled to the second end of a lug body; and a coil spring encircling each lug body between lower aperture and a shaft stop, the coil spring adapted to prevent the lug body from dropping down due to vibrations loosening the tension rods.

3. A free floating drum head tensioning system (10) for equally and oppositely tensioning upper and lower drum heads on a shell without piercing either the drum heads or the shell, the tensioning being achieved in a more convenient, more reliable and more economical manner, the system comprising, in combination:

a rigid drum shell (14) in a hollow cylindrical configuration, the drum shell having an interior surface (16) and an exterior surface (18), the drum shell having an upper peripheral edge (20) and a lower peripheral edge (22), the upper and lower peripheral edges being in spaced parallel planes;

a flexible upper drum head (26) extending across the upper peripheral edge and extending downwardly along the exterior surface, a flexible lower drum head (28) extending across the lower peripheral edge and extending upwardly along the exterior surface;

an upper hoop (32) having a circular vertical upper section (34) continuously securing the upper drum head against the shell adjacent to the upper peripheral edge, the upper hoop having a circular vertical lower section (36) non-continuously securing the upper drum head against the shell adjacent to the vertical upper section of the upper hoop, the vertical lower section of the upper hoop having horizontal regions (38) symmetrically spaced around the drum shell, each horizontal region of the upper hoop having an upper aperture (44);

a lower hoop (48) having a circular vertical lower section (50) continuously securing the lower drum head against the shell adjacent to the lower peripheral edge, the lower hoop having a circular vertical upper section (52) non-continuously securing the lower drum head against the shell adjacent to the vertical lower section of the lower hoop, the vertical lower section of the lower hoop having horizontal regions (54) symmetrically spaced around the drum shell, each horizontal region of the lower hoop having a lower aperture (56), each lower aperture having an associated upper aperture, the hoops being fabricated of a generally rigid material chosen from the class of generally rigid materials including metal, plastic, composites and wood;

a plurality of lug bodies (60), each lug body having a lower end (62) extending through a lower aperture, each lug body having a drilled and threaded upper end (64) located beneath an associated upper aperture;

a plurality of threaded tension rods (68), each threaded tension rod having a head above and a threaded end below extending downwardly through an upper aperture and threadedly coupled to the drilled and threaded upper end of a lug body, a flat washer (70) encompassing each threaded tension rod between a head and an upper aperture, the threaded tension rods adapted to tighten and loosen the tension of the drum heads;

a diametric aperture (74) in each lug body adjacent to the lower end, each diametric aperture positioned below a lower aperture, a cotter pin (76) extending through each diametric aperture, a washer (78) positioned between each lower aperture and a lower aperture; and a plurality of shaft stops (82), each shaft stop having a V-shaped exterior configuration with a D-shaped aperture (84), each lug body having a D-shaped surface spaced above the lower aperture receiving the D-shaped aperture, spaced grooves (86) in each lug body above and below a shaft stop, a snap ring (88) in each groove for axially fixing the shaft stop on a lug body, the stop shafts adapted to prevent rotation of lug body while pressure is being applied to the drum heads, a coil spring (90) encircling each lug body between a lower aperture and a shaft stop, the coil spring adapted to prevent the lug body from dropping down due to vibrations loosening the tension rods.

* * * * *